US005345990A

United States Patent [19]

Potts

[11] Patent Number: 5,345,990

[45] Date of Patent: Sep. 13, 1994

[54] DECORATIVE WALL HANGING ARTICLE

[76] Inventor: Kenneth J. Potts, 811 Brookline Ave., Louisville, Ky. 40215

[21] Appl. No.: 135,785

[22] Filed: Oct. 13, 1993

[51] Int. Cl.[5] ..... E04F 10/00

[52] U.S. Cl. ..... 160/38

[58] Field of Search ..... 160/38, 19, 330, 348; 5/481, 470, 643; 297/452.61, 452.60, 452.32, 452.21, 452.55; 223/109 R; 40/596, 538

[56] References Cited

U.S. PATENT DOCUMENTS

| | | | |
|---|---|---|---|
| 2,998,062 | 8/1951 | Bixey | 160/39 |
| 3,332,092 | 7/1967 | Hannlein | 297/452.21 |
| 4,776,636 | 10/1988 | Pyle et al. | 297/452.60 |
| 4,867,508 | 9/1989 | Urai | 297/452.61 X |
| 5,014,375 | 5/1991 | Coonrad et al. | 5/481 X |
| 5,025,519 | 6/1991 | Spann et al. | 5/481 X |
| 5,081,728 | 1/1992 | Skinner | 5/470 X |
| 5,159,965 | 11/1992 | Roy et al. | 160/38 |

FOREIGN PATENT DOCUMENTS

| | | | |
|---|---|---|---|
| 223014 | 10/1968 | Sweden | 297/452.55 |
| 1018951 | 2/1966 | United Kingdom | 297/452.6 |

*Primary Examiner*—Blair M. Johnson
*Attorney, Agent, or Firm*—Camoriano & Smith

[57] ABSTRACT

A decorative wall hanging form having a fabric attached thereto for decorative appearance. The article is of a soft and flexible material having a rigid member abutting the from along a region adjacent the perimeter of the rigid member and secured to the form along points interior to said region of abutment. There are curved shapes separated by slits into which the fabric is tucked. The fabric is also tucked into the region between the of abutment.

6 Claims, 1 Drawing Sheet

DECORATIVE WALL HANGING ARTICLE

BACKGROUND OF THE INVENTION

The present invention relates to generally to wall hanging articles and more particularly to wall hanging articles that can be covered by a fabric with no stitching.

Treatments of walls and windows are legion in number. However, it is desirable to have wall hangings and window treatments that can be easily replaced with other and different designs or just merely a change of fabric covering an existing design. Most changes require time consuming and expensive replacement activities which include much stitching of material. One example of an attempt to avoid the necessity of stitching of material is found in U.S. Pat. No. 5,152,331 entitled No-Sew Window Treatment issued to D. A. Barone on Oct. 6, 1992. A semi-soft form of a specified shape is provided with a single slot running the length of the form, A fabric then can be wrapped around the form and tucked into the slot and holds the fabric in place, To provide for other shapes and designs other than the ones shown the patentee suggests that several forms could be employed together.

The prior art such as the above fall short of providing a simple technique of changing fabrics and forms that permits the rapidly changing of the fabric and/or form so as to allow for a multiplicity of designs without the need for expensive fabric alteration and stitching, The prior art further fails to provide for a form with a multiple shapes in the surface thereof which can be covered by a fabric and conformed to the surface thereof without considerable stitching requirements.

It is therefore one object of the present invention to provide for a form that has decorative shapes in the surface or surfaces thereof and permits the rapid covering of the form so as to commit the fabric to the various shapes of the curvatures and to maintain the fabric in that condition without stitching.

It is still another object of the present invention to provide for a form with decorative shapes in the surface or surfaces thereof and a rigid backing thereto which permits the rapid and stitchless changing of fabric about the form.

These and other objects will be apparent to those skilled in the art upon a reading of the foregoing description and appended drawings.

SUMMARY OF THE INVENTION

The present invention provides for a decorative wall hanging article for detachably securing fabrics thereto and providing a decorative appearance. The article has a form made from a flexible and soft material and a rigid member abutting the form along a region adjacent the perimeter of the rigid member and secured to the form along points interior to said region of abutment. The form has a surface provided with a plurality of spaced curved shapes separated by slits extending into the material of the form. Each of the slits is formed by a pair of opposing shoulders of the form which abut one another. A fabric is then tucked into the slits and between the form and the rigid member in the region of abutment in such a manner so that the fabric conforms to said spaced curved shapes and provides said article with a decorative appearance. The material of the form and the fabric have a high coefficient of friction therebetween so as to provide stability to the shape taken on by the fabric over the surface of the article.

BRIEF DESCRIPTION OF THE DRAWING

The present invention will be better understood from the following detailed description of the preferred embodiment of the present invention when considered in connection with the accompanying drawing in which.

DESCRIPTION OF THE PREFERRED EMBODIMENT

Figure 1:
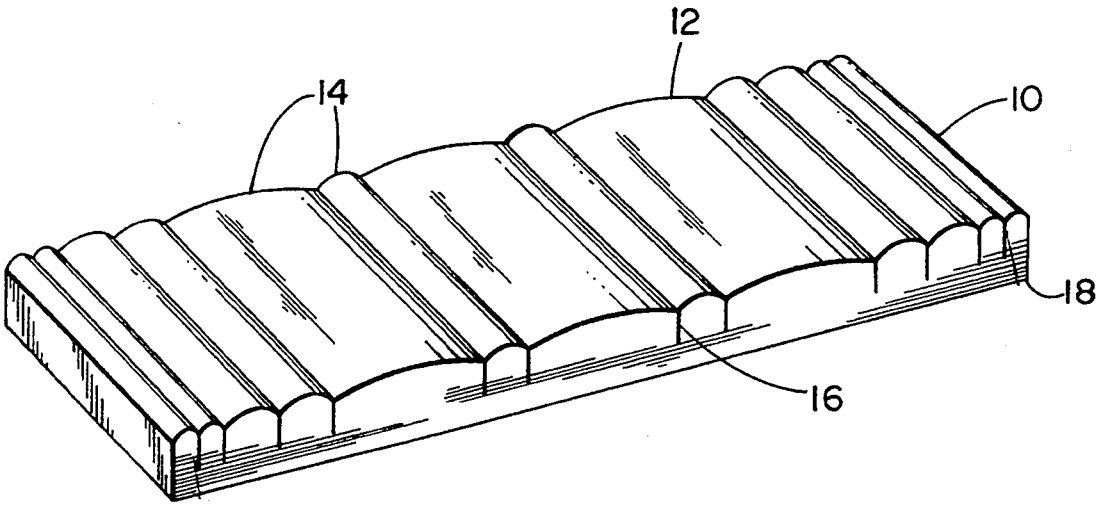
FIG. 1 is a perspective of the article of the present invention showing the surface that is provided with the spaced curved shapes separated by fabric holding slits.
Figure 2:
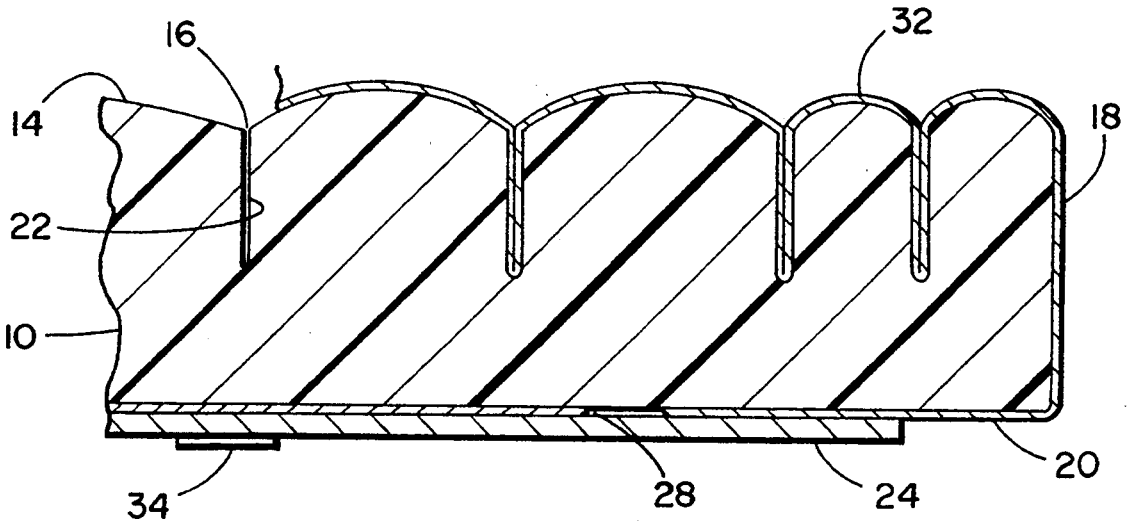
FIG. 2 is a side sectional view of the article of claim 1 with the fabric shown tucked into the slits and in the region of abutment between the form and a more rigid member.
Figure 3:
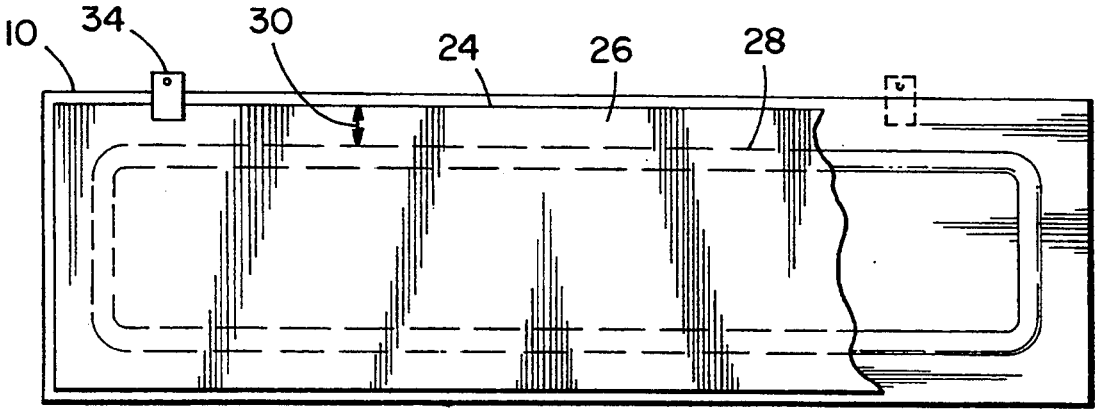
FIG. 3 is bottom elevation view of the article of the present invention showing a portion of the rigid member cut away to illustrate the adhesion line of the rigid member to the article surface.

It may be seen in the perspective of FIG. 1 and the side sectional illustration of FIG. 2 that the article of the present invention is comprised of a member 10 having a first major surface 12 that is provided with a plurality of shapes 14 separated by slits 16 that extend between sides 18. The shapes may be of different widths and geometries as desired with the only constraint that each shape be separated by slits. Slits 16 are cut partially through the thickness of member 10 and are defined by a pair of opposing shoulders 22 that are in an abutting relationship. Member 10 is made from a soft and flexible material that preferably is opened celled such as foamed polyurethane so as to provide good frictional holding characteristics to a fabric when tucked into slits 16 and made to conform to shapes 14. The depth of slits 16 depends upon the type of the fabric material chosen and the frictional characteristics of the flexible material. Preferably the selected depth is in a range of one-half to one-half inches.

To provide rigidity and good handling characteristics to the article of the present invention and to promote superior adherence of the fabric to the article, rigid member 24 is attached to the other major surface 20 of flexible member 10. The specific type of securing arrangement may be chosen as desired although some type of adhesive is preferred. It is important, however, that the surface of rigid member 24 be in a snug abutting relationship with major surface 20 in region 26 adjacent the periphery member 24. That is, surface 20 should be biased against but separable from member 24 in region 26 so that a fabric can be tucked and effectively secured against movement through the frictional engagement with surface 20 as promoted by the abutting relationship of member 24.

The surface of rigid member 24 can be provided with wall hangers 34 so as to easily mount the article on a vertical wall if desired as seen in FIG. 2. Other and different fasteners can be used in the ends of member 10 as desired to provide for mounting of the article when covered wherever desired. The particular material used for the rigid member can be any material that is compatible with the material chosen for member 10. However, it is preferred that the rigid member be comprised of lightweight material that can be readily adhered to open cell foam material and can effectively be secured to most hangers 34. Any higher density, more rigid thermoplastic material such as a polyethylene may be employed.

It is preferable that member 24 be adhered to surface 20 of member 10 along a continuous line of adherence 28 interior to the periphery 20*a* of rigid member 24 a distance 30 sufficient to provide a meaningful region of abutment 26. The distance 30 from periphery 20*a* to the line of adherence 28 like the depth of slits 16 depends to a large extent upon the frictional characteristics between materials and the abutting pressure between surfaces. It has been determined that the distance 30 should be no less than about one-half inch in order that the fabric be securely retained between rigid member 24 and surface 20.

As is seen in FIG. 2 a fabric 32 has been tucked into slits 16 between opposing shoulders 22 and stretched to conform to the surface of the shapes 14. Additionally, fabric 32 has been tucked into the abutting region 26 completely around the exposed exterior of flexible member 10. The resulting frictional force between fabric 32 and the open cell foam material of member 10 maintains fabric 32 in its conforming relationship to shapes 14 without stitching or any other means of connection to flexible member 10. Thus, the fabric can be replaced with other fabrics of different patterns easily without tearing or restitching. Additionally, the fabric covered article can be handled in the ordinary course of use without concern that the fabric will separate from its conforming relationship.

The member 10 as shown is a parallepiped but other configurations can be chosen as well. For example, disk or pie shape members or other geometries may be used for the overall shape of member 10. The major criteria is that the fabric must be secured and separable at all ends thereof in order that the fabric be conformed to whatever design or shapes may populate the surface of the member 10 to be exposed to the viewing eye. For example, should member 10 have an essentially cylindrical shape, then it would be appropriate for the surface portion away from the viewing eye be used to secure the ends of the fabric in a desired manner. For example, such surface portion could be made into a planar shape such that the rigid member could be attached thereto and an abutting region be formed for the fabric to be tucked between rigid member 24 and the abutting surface of the member 10.

While the present invention has been described with the preferred embodiment as the focus, it will be appreciated that various changes and modifications can be made, for example, to provide other designs of the flexible member without departing from the intended scope and spirit of the claims.

I claim:

1. A decorative wall hanging article for detachably securing fabrics thereto and providing a decorative appearance comprising a form made from a flexible and soft material having a surface provided with a plurality of spaced shapes separated by slits extending into the material of said form, a rigid member having a perimeter and substantially continuously abutting said form along a region adjacent the perimeter of said rigid member and substantially continuously secured to said form along points interior to said region of abutment, and a fabric tucked into said slits and between said form and said rigid member in the region of abutment wherein said fabric conforms to said spaced shapes and provides said articles with a decorative appearance.

2. The article of claim 1 in which said slits are formed between abutting shoulders of said form.

3. The article of claim 1 in which said form has a first major surface having said spaced shapes and slits and a second major surface to which said rigid member is secured.

4. The article of claim 3 in which said form and said rigid member are adhered together along a continuous line located to the interior of said region of abutment.

5. The article of claim 4 in which said form has a parallelpiped shape and said slits are spaced in a parallel relationship along said first major surface.

6. The article of claim 6 in which said material is an open cell foamed material.

* * * * *

UNITED STATES PATENT AND TRADEMARK OFFICE

CERTIFICATE OF CORRECTION

PATENT NO. : 5,345,990

DATED : September 13, 1994

INVENTOR(S) : Kenneth J. Potts

It is certified that error appears in the above-indentified patent and that said Letters Patent is hereby corrected as shown below:

In column 4, line 41, claim 6 should read

--The article of claim [6] 5 --

Signed and Sealed this

Eighth Day of November, 1994

Bruce Lehman

*Attest:*

BRUCE LEHMAN

*Attesting Officer*

*Commissioner of Patents and Trademarks*